US008973311B1

(12) United States Patent
Nolte et al.

(10) Patent No.: US 8,973,311 B1
(45) Date of Patent: Mar. 10, 2015

(54) MOBILE ELEVATED BUILDING

(71) Applicants: Roger Allen Nolte, Concord, NC (US); Adam D. Baird, Salisbury, NC (US)

(72) Inventors: Roger Allen Nolte, Concord, NC (US); Adam D. Baird, Salisbury, NC (US)

(73) Assignee: Kontek Industries, Inc., Kannapolis, NC (US)

( * ) Notice: Subject to any disclaimer, the term of this patent is extended or adjusted under 35 U.S.C. 154(b) by 0 days.

(21) Appl. No.: 14/220,872

(22) Filed: Mar. 20, 2014

Related U.S. Application Data

(63) Continuation of application No. 13/836,412, filed on Mar. 15, 2013, now Pat. No. 8,726,584.

(51) Int. Cl.
*E04B 2/82* (2006.01)
*E04H 1/12* (2006.01)

(52) U.S. Cl.
CPC ..... *E04H 1/12* (2013.01)
USPC ..... 52/126.1; 52/122.1

(58) Field of Classification Search
CPC ..... E04H 1/12; B66F 11/04; B66F 11/046; E04G 1/18; E04G 1/22; E04G 1/24
USPC ..... 52/122.1, 126.1; 182/12–14, 2.2, 2.5, 182/2.9, 2.11
See application file for complete search history.

(56) References Cited

U.S. PATENT DOCUMENTS 3,556,249 A 1/1971 Jackson
4,962,827 A 10/1990 Garnett
6,475,058 B2 * 11/2002 Mammano et al. ..... 446/426
7,806,628 B2 * 10/2010 Willis ..... 405/166
2004/0020717 A1 * 2/2004 Robillard ..... 182/141
2006/0219478 A1 * 10/2006 Severs et al. ..... 182/2.9
2013/0112500 A1 5/2013 Keersmaekers
2013/0205711 A1 * 8/2013 Heltoft et al. ..... 52/745.17
2014/0144724 A1 * 5/2014 St-Germain et al. ..... 182/69.6

OTHER PUBLICATIONS

Pending U.S. Appl. No. 13/836,412, filed Mar. 15, 2013 and titled "Mobile Elevated Building", by Roger Allen Nolte and Adam D. Baird.

* cited by examiner

*Primary Examiner* — Mark Wendell
(74) *Attorney, Agent, or Firm* — Barclay J. Tullis

(57) ABSTRACT

A mobile elevated building assembly is configured to be compactly transportable in a transportation mode yet readily reconfigured to an installed mode after set-up with a building held many meters off of the ground by a tower supported off of the ground by outriggers. A flat-bed trailer is used to transport the assembly while in its transportation mode, and the trailer can optionally remain attached to the bottom of the tower in the installed mode. A foldable stairway and top-of-stairs platform can form a subassembly that can be pivotally attached where they connect to one-another, and this connection can be supported by a horizontal upper member of the tower. The platform can include one of at least two horizontal support members for holding the building on top of the tower. Methods are provided for reconfiguring the assembly and subassemblies between their transportation mode and their installed mode.

21 Claims, 3 Drawing Sheets

MOBILE ELEVATED BUILDING

CROSS-REFERENCE TO RELATED APPLICATIONS

This application is a co-owned continuation application of parent application Ser. No. 13/836,412 titled "Mobile Elevated Building" and filed Mar. 15, 2013, all of which is incorporated herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to elevated buildings and in particular to ones that can be reconfigured into a compact assembly that can be easily transported as a single mobile unit from one location to another on an included flat-bed trailer.

2. Description of the Related Art

In the prior art, buildings that are small enough to be transported readily without requiring their disassembly usually require either being dragged, being lifted and moved by one or more fork-lift trucks, or being placed onto the bed of a commercial truck for transport to a new or next location. If both a building and a tower upon which it is to sit are to be transported, they are usually separated from one-another and each moved independently of the other.

BRIEF SUMMARY OF THE INVENTION

The invention is pointed out with particularity in the appended claims. However, some aspects of the invention are summarized in the following descriptions of some possible implementations and examples.

A mobile elevated building assembly is configured to be compactly transportable in a transportation mode yet readily reconfigured to an installed mode after set-up with a building held many meters off of the ground by a tower supported off of the ground by outriggers. A flat-bed trailer is used to transport the assembly while in its transportation mode, and the trailer can optionally remain attached to the bottom of the tower in the installed mode. A foldable stairway and top-of-stairs platform can form a subassembly that can be pivotally attached where they connect to one-another, and this connection can be supported by a horizontal upper member of the tower. The platform can include one of at least two horizontal support members for holding the building on top of the tower. Methods are provided for reconfiguring the assembly and subassemblies between their transportation mode and their installed mode.

In one embodiment of the invention, a mobile elevated building comprises a building, a tower structure, and a mobile platform; wherein the tower has a structure that permits lowering the building down into the tower for configuration as a transportation mode; and wherein the building can be raised out of the tower and installed on top of the tower for configuration as an installed mode. This embodiment can further comprise a foldable staircase that is foldable sideways to accommodate the transportation mode. It can comprise a top-of-stairs platform coupled pivotally to an upper horizontal element of the tower; wherein the top-of-stairs platform can be pivoted from a horizontal orientation to a tilted orientation to give clearance for the building to be lowered from above and inserted into the tower. It can further comprise both a foldable staircase and a top-of-stairs platform; wherein the foldable staircase and the top-of-stairs platform are each connected to one another by at least part of a horizontal pivotal mechanism that permits either or both their being rotated as a single unit and/or being rotated independently of one another. The foldable staircase, when folded, can be pivoted downward to accommodate the transportation mode by requiring less extension toward the rear of the mobile platform than when the foldable staircase is unfolded. Also a horizontal cross member can be used to support the building atop the tower and be attached to the top-of-stairs platform such that it rotates with the top-of-stairs platform in its rotation about the horizontal pivot mechanism.

Various methods are included. One method is for transforming a mobile elevated building from a transportation mode to an installed mode and comprises the steps of positioning the mobile elevated building at a location for installation, hoisting a building out of a tower structure, deploying outriggers from a mobile platform and lowering the building onto the tower structure. This method can also comprise steps of rotating a top-of-stairs platform to position an attached support member atop the tower; unfolding a staircase attached to the tower, wherein the staircase had previously been folded sideways for the transportation mode; and in the unfolding step can first include rotating the folded staircase upward to extend farther toward the rear of the mobile platform. Another example method is for transforming a mobile elevated building from an installed mode to a transportation mode and comprises the steps of hoisting the building clear of the tower, lowering the building into the tower, and driving away with the mobile elevated building assembly. This additional example method can also comprise steps of folding a staircase sideways that is attached to the tower, rotating a top-of-stairs platform sufficiently to move a building support member attached to the platform out of the way of the building to give the building enough clearance to be lowered into the tower, and the folding step can include following with a rotation of the folded staircase downward.

OBJECTS AND ADVANTAGES OF THE INVENTION

Objects and advantages of the present invention include a building and tower assembly that is mobile by way of its own flat-bed trailer, and is conveniently and rapidly reconfigurable between a compact transportation mode for travel and an installed mode for full, and possibly temporary, deployment at a fixed location with the building atop the tower. In the transportation mode configuration, the bed of the flat-bed trailer can be attached to the base of the tower. In the installed mode, the flat-bed trailer can optionally remain attached to the base of the tower or be detached from the base and removed. The base of the tower includes horizontal box beam members for receiving outriggers in the installed mode. The outriggers support the assembly from the ground in the installed mode, and the outriggers take at least most of the weight load from the building and tower off of the tires of the trailer if the trailer is to remain attached to the base of the tower in the installed mode. In the transportation mode, the building is located mostly inside of the tower. By transporting the building within the tower, both together require little if any additional footprint area on the flat-bed trailer than would be required for the tower alone. A foldable stairway can be included in the overall assembly and configured to fold sideways near the middle of the stairway to reduce its overall length for safe transport. When the building is set-up as an installed on top of the tower before or after transport, the stairway can reach from ground level up to a top-of-stairs platform at a doorway of the building. Both the platform and the stairway can be pivotally attached to an upper horizontal member of the tower, thus enabling convenient repositioning of the stairway and/or platform between the transportation mode and the installed mode. And the platform can include an attached horizontal structural element that in the transportation mode is positioned out of the way of the building, and in the installed mode is positioned between the building and the tower to provide the building one of footings to help hold the building atop the tower. Each embodiment of the current invention provides a transformable assembly of a building and tower that can be reconfigured back and forth between a transportation mode and an installed mode, wherein the tower in transportation mode is located in the tower rather than on top of it. This invention is particularly suited for supporting an armored building elevated from the ground, as the weight of such a building can easily surpass 10,000 kilograms, and it would be advantageous, give the cost of such a building, to be able to rapidly redeploy it as the need arises.

The various features and further advantages of the present invention(s) and their preferred embodiments will become apparent to ones skilled in the art upon examination of the accompanying drawings and the following detailed description. It is intended that any additional advantages be incorporated herein. The contents of the following description and of the drawings are set forth as examples only and should not be understood to represent limitations upon the scope of the present invention(s).

BRIEF DESCRIPTION OF THE SEVERAL VIEWS OF THE DRAWINGS

The foregoing objects and advantages of the present invention(s) of a mobile elevated building assembly may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion. Within these drawings.

DETAILED DESCRIPTION OF THE INVENTION

Figure 1:
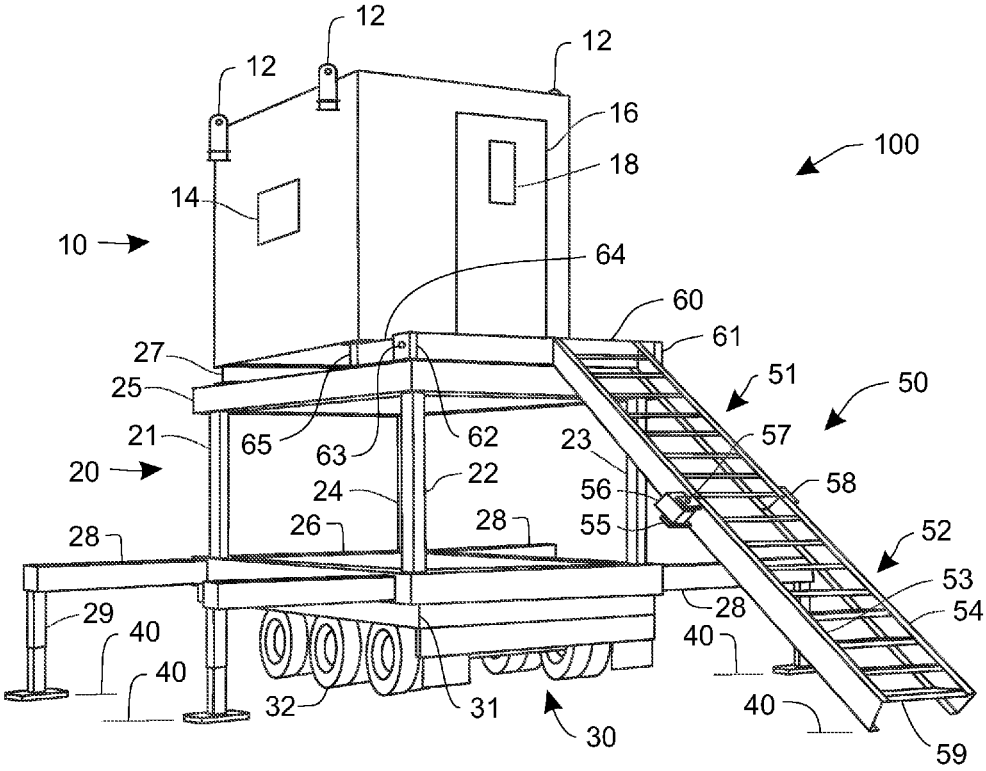
FIG. 1 shows a perspective view looking forward and from the left side and rear of one embodiment of a mobile elevated building assembly according to the current invention, in particular showing the assembly configured in an installed mode and having a deployed staircase and outriggers.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims. Within these drawings, callouts using like reference numerals refer to like elements in the several figures (also called views) where doing so won't add confusion, and callouts with primes are to objects that may be similar but have some difference(s) from those objects identified by the un-primed call-outs. The following is a list of definitions for both words and phrases as used within this disclosure and the claims that are given a particular meaning in this disclosure and not intended to be interpreted in their broadest meaning:

a) "tower" means a structure for holding something more than a couple of meters off of the ground;
b) "mobile platform" means a trailer or other wheeled or tracked vehicle having a generally flat surface for transporting heavy objects;
c) "locking mechanism" means a mechanism or device suitable for fastening two or more objects together;
d) "top-of-stairs platform" means an apparatus located at the top of a staircase and used by people for traversing a distance beyond the top of the stairs of the staircase, or to pause at the top of the stairs or just beyond the top of the stairs;
e) "installed mode" means a configuration of an assembly as installed at a fixed location;
f) "transportation mode" means a configuration of an assembly prepared for safe travel on public highways;
g) "folded staircase" means a staircase consisting of at least two individual but pivotally interconnected length-wise segments of the staircase, wherein the two segments are not co-linear but parallel and side-by-side;
h) "unfolded staircase" means a staircase consisting of at least two individual but pivotally interconnected length-wise segments of the staircase, wherein the two segments are co-linear and parallel, end-to-end, and not side-by-side.

FIG. 1 shows a perspective view looking forward from the left side and rear of one embodiment of a mobile elevated building assembly 100 according to the current invention, in particular showing the assembly 100 configured in an installed mode (as opposed to a reconfiguration for a transportation mode shown in FIG. 2) and having a deployed staircase 50 and four outriggers. In this example, each of the outriggers is comprised of an outrigger arm 28 connected to a leg and foot 29. Suitably, the configuration of the installed mode includes a building 10 supported above an elevating structure 20 which in this disclosure will be referred to as a tower. The four outrigger arms 28 are inserted into channels 70 (called out in FIGS. 2 and 3, but not in FIG. 1) within the bottom horizontal frame 26 of the tower 20. The tower is comprised of four vertical support posts 21, 22, 23, and 24 located near the corners of both the bottom horizontal frame 26 and an upper horizontal frame 25. The tower 20 sits on the bed of a flat-bed trailer 30. In this view from the left and rear, locations left and right as well as forward and rear are relative to the direction the mobile flatbed trailer 30 would travel forward down a highway; this view shows the left and rear of the assembly 10. In the installed mode, the outriggers are made to stand on the ground 40 (or other base material) and support the weight of at least the tower structure 20 and the building 10. When in this configuration the mobile flatbed trailer 30, which includes its trailer bed 31 wheels 32, could optionally be detached and removed.

The building shown in FIG. 1 includes four lifting attachment devices 12 for a crane to connect to for lifting and lowering the building to/from the tower. The building 10 shown is shown to include a side window 14 and a door 16, with the door including another window 18. In the installed mode, the building 10 is positioned on the upper surfaces of two horizontal footings: a forward footing 27 and a rear footing 65, both of which are sandwiched between the building 10 and the top horizontal frame of the tower 20.

Figure 2:
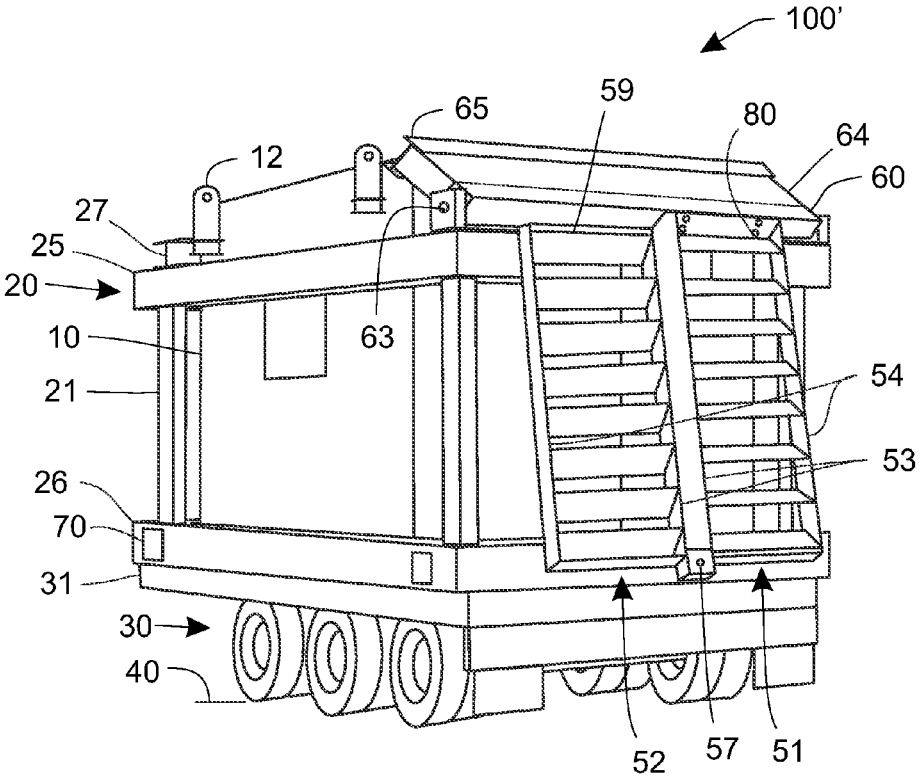
FIG. 2 shows a similar perspective view of the same embodiment of the mobile elevated building assembly embodiment shown in FIG. 1, but for comparison showing the assembly configured in a transportation mode.

The staircase 50 shown in FIG. 1 is reconfigurable between this installed mode and the transportation mode (the transportation mode is shown in FIG. 2). In this installed mode shown, the staircase 50, which is foldable, is in its unfolded mode providing a straight flight of stairs for personnel to transit the journey from the bottom of the stairs to the top of the stairs. The staircase itself 50 comprises a left support rail 53 and a right support rail 54 between which each step or stair-step is located (such as the bottom step or stair 59). The bottom of the staircase 50 is on or very close to the ground 40. The top of the staircase 50 is attached just above the rear side of the top horizontal frame of the tower 20. The staircase 50 comprises an upper section 51 and a lower section 52 coupled together where they meet one another by a clamp 58 on the right side, and by a hinge on the left side in this example. In this example, the hinge comprises upper and lower pivot plates 55 both attached to the upper region on the left side of the lower section 52 of the folding staircase 50. Also in this example, the hinge comprises a pivot block 56 and axis pin 57, wherein the axis pin 57 engages clearance-fit holes in the upper and lower pivot plates 55. One skilled in the art will recognize that there are many alternative designs possible for such a hinge. Importantly to this implementation, the axis of the axis pin 57 is oriented perpendicular to the principal plane of the staircase.

As seen in FIG. 1 and as already mentioned, the staircase 50, or rather the upper end of the upper section 51, is attached just above the rear side of the top horizontal frame of the tower 20. This attachment is to both ends of a horizontal pivot support bar 60 that is pivotally mounted at those ends by pivot pins 63 inserted into a right pivot base 61 and a left pivot base 62. Both pivot bases 61 and 62 are attached to the upper surface of the top horizontal frame 25 of the tower 20. The combination of a pivot support bar 60 with a right pivot base 61 and a left pivot base 62 as well as one or more horizontal axial pins 63 working in this way can together be called a horizontal pivot mechanism. A top-of-stairs platform 64 is also attached to pivot support bar 60, such that both the top-of-stairs platform 64 and the folding staircase 50 would rotate together if either one were to rotate about the pivot axial pins 63. The purpose of this partnership between the top-of-stairs platform 64 and folding staircase 50 is to allow for efficient rotation of the two in transforming the mobile elevated building assembly back and forth between the configurations corresponding to the installed mode and the transportation mode, as in moving one moves the other. The rear footing 65 for the building 10 above the top of the tower 20 is attached to the top-of-stairs platform 64 such that when the top-of-stairs platform 64 is horizontal as in the installed configuration, the rear footing 65 will be in place to help support the building above the tower 20. And when the staircase 50 is folded and lowered (after the building 10 has been removed from the assembly 100 to transform the assembly between the two modes (installed mode and transportation mode), the top-of-stairs platform 64 with the rear footing 65 will have rotated upward putting both clear of the building 10. This clearance allows for the building to be shifted rearward to clear also the forward footing 27 as needed to lower it into the tower 20 when transforming to the transportation mode. One skilled in the art will recognize that other means could be used to accomplish moving the top-of-stairs platform 64 and/or the rear footing 65 into and out of place for configuring the installed mode. And one skilled in the art will recognize that the top-of-stairs platform 64 and foldable staircase 50 could be hinged separately from one another or even not at all in other implementations of the invention(s). Incidentally, staircase bannisters and other handrails are not shown in these figures in order to not clutter the views.

FIG. 2 shows a similar perspective view of the same embodiment of the mobile elevated building assembly embodiment shown in FIG. 1, but for comparison showing the assembly 100' configured in a transportation mode, whereas the assembly 100 in FIG. 1 is configured in the installed mode. The use or not of a prime on the callout number here denotes different configurations of the same assembly components. FIG. 2 shows the foldable staircase 50 (callout not shown here) with its two segments or sections 51 and 52 rotated relative to one another such that one section is now alongside and parallel to the other, which is referred to in this disclosure as not collinear but as parallel and side-by-side. The foldable staircase 50 is therefore shown here to be folded and therefore can now be referred to as a folded staircase, and in addition it has been rotated or tilted downward so that the two sections 51 and 52 don't reach out as far rearward from the tower as when they are in the installed configuration folded or unfolded. Note that the two sections/segments of the left support rail 53 are here closer to one another than are the two sections/segments of the right support rail 54 which are now at opposite sides of the folded staircase. This view doesn't show each of the outriggers 28 or each leg and foot 29 as they can be stowed for travel with the assembly 100' by placing them inside the building 10. The top-of-stairs platform 64 is shown rotated and tilted upward from the pivot support bar 60, placing the attached rear footing 65 rearward away and out from underneath the building 10 where it would be in the installed mode. The clearance provided by this tilting of the top-of-stairs platform 64 with its attached rear footing 65 aids in allowing the building 10 to be placed rearward of the forward footing 27 as it is lowered into receiving space within the structure of the tower 20 and set down on the flat-bed of the flat-bed frame 31. As before, bannisters and handrails are not shown on the foldable staircase 50 in order to not clutter the view.

Figure 3:
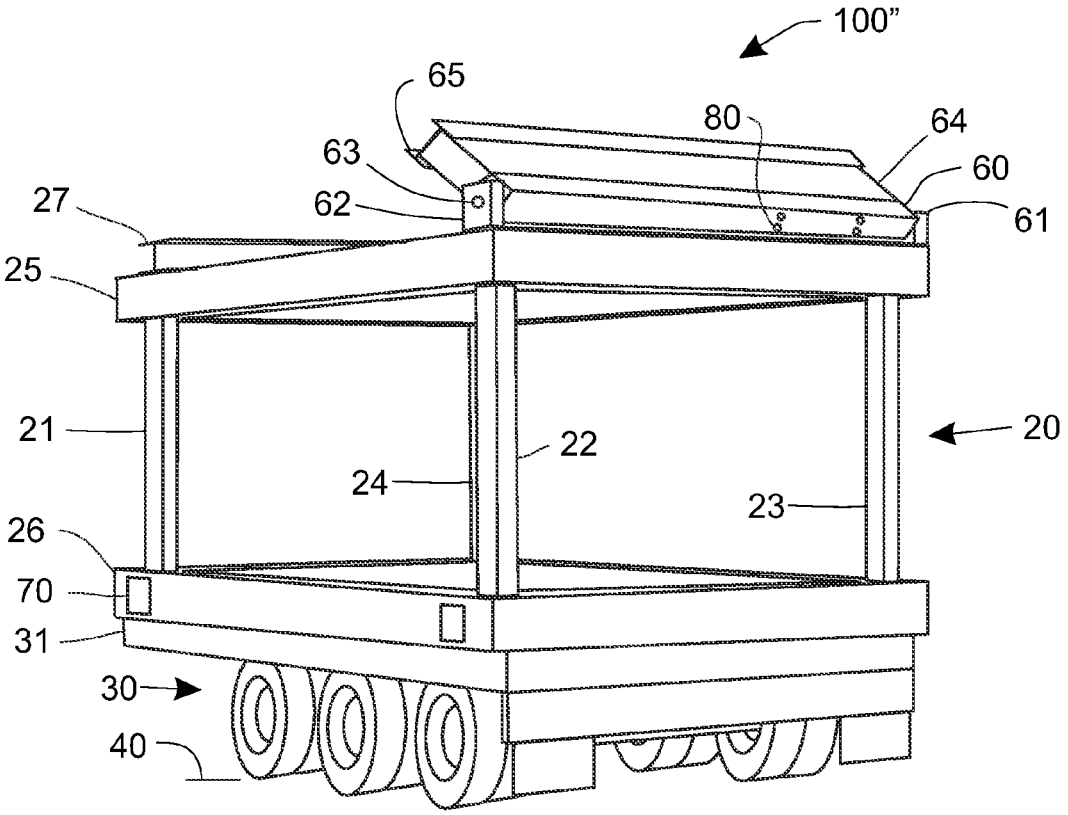
FIG. 3 shows a similar perspective view as in FIG. 2, however the building, outriggers, and stairway have been removed for illustration purposes.

FIG. 3 shows a similar perspective view as in FIG. 2, however the building 10, outriggers 28 each with its leg and foot 29, and foldable stairway 50 have been removed for illustration purposes to show what remains, where the configuration callout 100" has a double-prime to denote its missing parts. In this view, a hole pattern 80 is visible where the foldable staircase 50 would be attached in either installed or transportation mode. And the top-of-stairs platform 64 is viewed in its tilted orientation with the rear footing 65 raised and moved backward from its position when supporting the building 10. The forward footing 27 is also visible atop the top horizontal frame 25 of the tower 20. All the callouts shown are the same ones shown in FIGS. 1 and 2.

Embodiments of the present invention include methods used in the transformation (or partial transformation) of a building and tower assembly between a transportation mode and an installed mode. One method example is for transforming a mobile elevated building from a transportation mode to an installed mode and comprises the steps of positioning the mobile elevated building at a location for installation, hoisting a building out of a tower structure, deploying outriggers from a mobile platform and lowering the building onto the tower structure. This method can also comprise steps of rotating a top-of-stairs platform to position an attached support member atop the tower; unfolding a staircase attached to the tower, wherein the staircase had previously been folded sideways for the transportation mode; and in the unfolding step can first include rotating the folded staircase upward to extend farther toward the rear of the mobile platform. Another example method is for transforming a mobile elevated building from an installed mode to a transportation mode and comprises the steps of hoisting the building clear of the tower, lowering the building into the tower, and driving away with the mobile elevated building assembly. This additional example method can also comprise steps of folding a staircase sideways that is attached to the tower, rotating a top-of-stairs platform sufficiently to move a building support member attached to the platform out of the way of the building to give the building enough clearance to be lowered into the tower, and the folding step can include following with a rotation of the folded staircase downward. One skilled in the art will recognize that the invention is not limited to methods of transformation, between installed mode and transportation mode, that move the building 10 into or out of the tower 20 as the tower is sitting on the mobile platform, be it a flat-bed trailer 30 or other vehicle providing a flat bed, as the tower 20 might be raised off of the flat-bed before the building 10, or lowered around the building 10 after the building has already been placed on the bed of the flat-bed trailer 30.

Although specific embodiments of the invention(s) have been illustrated and described herein, those of ordinary skill in the art will appreciate that any arrangement configured to achieve the same purpose may be substituted for the specific embodiments shown. This disclosure is intended to cover any and all adaptations or variations of various embodiments of the invention(s). It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention(s) includes any other applications in which the above structures and methods are used.

We claim:

1. A mobile elevated building comprising:

a. a building comprising at least one window, at least one door, and at least one or more attachment devices for attaching the building to a crane;

b. a tower structure; and c. a mobile platform underneath the building and tower;

wherein the tower has a structure that permits the crane to attach to the building and to lower the building down into the tower for configuring the building and the tower into a transportation mode; and wherein the building can be raised, by the same or another crane which can be attached to the building, out of the tower and installed on top of at least two horizontal footing elements on top of the tower for configuring the building and the tower into an installed mode.

2. The mobile elevated building of claim 1, further comprising:

a. a horizontal forward footing element and a horizontal rearward footing element, each of these two footing elements comprising its own upper surface;

b. a top horizontal frame of the tower;

wherein, in the installed mode, the building is positioned on the upper surfaces of the two horizontal footing elements both of which are sandwiched between the building and the top horizontal frame of the tower.

3. The mobile elevated building of claim 2, wherein one of the two horizontal footing elements is rigidly attached to the top of the tower, and the other horizontal footing element is pivotally attached to the tower.

4. The mobile elevated building of claim 3; further comprising a platform coupled pivotally to an upper horizontal element of the tower; wherein the platform can be pivoted from a horizontal orientation to a tilted orientation to give clearance for the building to be lowered from above and inserted into the tower.

5. The mobile elevated building of claim 4, wherein the other horizontal footing element is attached to the platform.

6. The mobile elevated building of claim 1, wherein the building is an armored building.

7. The mobile elevated building of claim 1, wherein the window is in the door.

8. The mobile elevated building of claim 1, wherein the at least one or more attachment devices are configured to collectively support the building's weight.

9. The mobile elevated building of claim 2;

wherein the mobile platform comprises a mobile flatbed trailer having a trailer bed and wheels;

wherein the tower includes outriggers; and wherein the flatbed trailer can be rolled away from the tower and building when the outriggers are supporting the tower and the building.

10. A method of transforming a mobile elevated building from a transportation mode, wherein a building is inside a tower, to an installed mode, wherein the building is on top of the tower, comprising the steps of:

a. providing a mobile elevated building comprising:

i. a building comprising at least one window, at least one door, and at least one or more attachment devices for attaching the building to a crane;

ii. a tower structure; and iii. a mobile platform underneath the building and tower;

wherein the tower has a structure that permits the crane to attach to the building and to lower the building down into the tower for configuring the building and the tower into a transportation mode; and wherein the building can be raised, by the same or another crane which can be attached to the building, out of the tower and installed on top of at least two horizontal footing elements on top of the tower for configuring the building and the tower into an installed mode;

b. positioning the mobile elevated building at a location for installation;

c. attaching a crane to the building;

d. hoisting the building out of the tower structure;

e. lowering the building onto the tower structure; and f. detaching the crane from the building.

11. The method of claim 10, wherein the building is an armored building.

12. The method of claim 10, further comprising the step of deploying outriggers from the tower.

13. The method of claim 10, further comprising the step of deploying a stairway from the ground up to the building.

14. The method of claim 10, further comprising the step of pivoting a horizontal footing element, pivotally attached to an upper portion of the tower, in order to provide clearance for the building during the hoisting step.

15. The method of claim 14, further comprising the step of pivoting the horizontal footing element in order to at least partially support the building upon completion of the lowering step.

16. The method of claim 15, further comprising the step of sandwiching the horizontal footing element between the building and the tower.

17. A method of transforming a mobile elevated building from an installed mode, wherein a building is on top of a tower, to a transportation mode, wherein the building is inside the tower, comprising the steps of:

a. providing a mobile elevated building comprising:

i. a building comprising at least one window, at least one door, and at least one or more attachment devices for attaching the building to a crane;

ii. a tower structure; and iii. a mobile platform underneath the building and tower;

wherein the tower has a structure that permits the crane to attach to the building and to lower the building down into the tower for configuring the building and the tower into a transportation mode; and wherein the building can be raised, by the same or another crane which can be attached to the building, out of the tower and installed on top of at least two horizontal footing elements on top of the tower for configuring the building and the tower into an installed mode;

b. attaching a crane to the building;

c. hoisting the building off of the tower;

d. lowering the building into the tower; and e. detaching the crane from the building.

18. The method of claim 17, wherein the building is an armored building.

19. The method of claim 18, further comprising the step of pivoting a horizontal footing element, pivotally attached to an upper portion of the tower, in order to provide clearance for the building during the lowering step.

20. The method of claim 18, further comprising the step of folding a stairway attached to the tower.

21. A method of assembling a mobile elevated building into a installed mode, comprising the steps of:

a. providing a mobile elevated building comprising:

i. a building comprising at least one window, at least one door, and at least one or more attachment devices for attaching the building to a crane;

ii. a tower structure; and iii. a mobile platform underneath the building and tower;

wherein the tower has a structure that permits the crane to attach to the building and to lower the building down into the tower for configuring the building and the tower into a transportation mode; and wherein the building can be raised, by the same or another crane which can be attached to the building, out of the tower and installed on top of at least two horizontal footing elements on top of the tower for configuring the building and the tower into an installed mode; and b. using a crane to lift the building out of the tower structure before placing it onto the top of the tower.

* * * * *